US005997265A

United States Patent [19]

Chung

[11] Patent Number: 5,997,265

[45] Date of Patent: Dec. 7, 1999

[54] BEARING STRUCTURE FOR RADIATING FANS

[75] Inventor: Yu-Ping Chung, Hsinchu, Taiwan

[73] Assignee: D-Link Corporation, Hsinchu, Taiwan

[21] Appl. No.: 08/984,641

[22] Filed: Dec. 3, 1997

[30] Foreign Application Priority Data

Sep. 23, 1997 [TW] Taiwan ..... 86216223

[51] Int. Cl.[6] ..... F04B 17/03

[52] U.S. Cl. ..... 417/423.13; 417/423.7

[58] Field of Search ..... 417/423.7, 423.12, 417/423.13

[56] References Cited

U.S. PATENT DOCUMENTS

| | | | |
|---|---|---|---|
| 1,888,714 | 11/1932 | Moss | 415/111 |
| 3,118,384 | 1/1964 | Sence et al. | 103/87 |
| 4,861,237 | 8/1989 | Shiraki et al. | 417/353 |
| 4,949,022 | 8/1990 | Lipman | 318/254 |
| 5,075,606 | 12/1991 | Lipman | 318/254 |
| 5,102,308 | 4/1992 | Bordelon | 417/423.13 |
| 5,492,458 | 2/1996 | Horng | 417/423.7 |
| 5,499,901 | 3/1996 | Rockwood | 415/111 |

*Primary Examiner*—Timothy S. Thorpe
*Assistant Examiner*—Ehud Gartenberg
*Attorney, Agent, or Firm*—Bacon & Thomas

[57] ABSTRACT

A bearing structure for a rotor shaft of a radiating fan includes a hollow post and, positioned within said hollow post, a bearing for said rotor shaft. An inside wall of bearing has formed therein at least one groove extending circumferentially around the inside wall and arranged to contain a lubricating oil for the bearing, thereby increasing an oil containing capacity of the bearing structure. The bearing is suspended in the hollow post such that a chamber or reservoir is formed below the bearing.

2 Claims, 2 Drawing Sheets

BEARING STRUCTURE FOR RADIATING FANS

BACKGROUND OF THE INVENTION

The subject invention relates to an improved bearing structure for radiating fans, and in particularly to one with a ring shaped groove along the radius on the inside of the bearing and a shaft rod mounted in the bearing so that when the shaft rod rotates continuously with the fan blades, the groove will enable the bearing to have an increased oil containing area, to minimize friction between the shaft rod and the bearing, and to extend its service life.

Conventionally, a regular electric fan is installed within the framework of a frame unit. At the center of the frame unit is a bearing carrier and at the center of the bearing carrier is a protruding hollow post. In the hollow post is an oil containing bearing, and surrounding the hollow post is mounted a stator. On the stator is mounted a fan unit, and surrounding the fan unit are several spiral shaped fan blades, the fan unit including a groove that accommodates the bearing carrier. In the groove is fixed an upright shaft rod that is made of stainless steel. The other end of the shaft rod is inserted into the bearing in the hollow post, and on the other end of the bearing carrier opposite to the hollow post is a vent that communicates with the hollow post. The vent is covered tightly by an oil cap when the device is in use. Since the bearing is a hollow sleeve with a smooth inside wall and open ends, lubricating oil often will seep out between the bearing and the shaft rod along the smooth inside wall in the bearing, and hence the lubricating oil is used up very soon. The result is friction between the shaft and the bearing and subsequent noise, shortening of the service life of the bearing, and increased manufacturers' costs in procurement and replacement. In order to eliminate the above weakness in the oil containing capacity of the bearing, some would replace it with a roller bearing that requires frequent refilling of lubricating oil. Although this will avoid such weaknesses as loss of lubricating oil and deterioration of the oil after a period of heated operation, the production of such roller bearings requires quite sophisticated and precise manufacturing processing, to produce a ball bearing with a diameter of 0.15 mm–0.20 mm, which costs too much time and labor, and as a result the production costs will be several times higher than the costs for producing oil containing bearings.

To eliminate the weaknesses of the above conventional devices and structures, the subject inventor has devoted extended efforts in intensive research and experiments, and has finally developed and designed the improved bearing structure for radiating fans of the invention.

SUMMARY OF THE INVENTION

The primary objective of the subject invention is to present a type of improved bearing structure for radiating fans, relating primarily to a bearing carrier on the cooling fans specially applied to electronic instruments and computers. On the bearing carrier is mounted a bearing, on the inside wall of the bearing is at least one ring shaped groove that extends along the radius, and in the bearing is inserted a shaft rod with its one end fixed on the fan blades, so that when the fan unit is driven to rotate continuously by the magnetic field induction produced by the combination of the stator and the ring magnet around the fan unit, the ring shaped groove on the inside wall of the bearing will increase its oil containing capacity to minimize friction between the bearing and the shaft rod, and also will keep the lubricating oil from rapidly flowing out from between the bearing and the shaft rod and thereby retain the oil within for a longer period of time. Such a design will extend service life by several times longer than for conventional bearings, which will significantly reduce the manufacturers' costs in procurement and replacement of parts.

Another objective of the subject invention is to present an improved structure of a bearing for radiating fans, by filling silicone oil in the bearing instead of a conventionally used lubricating oil, whereby the silicone oil's properties of resistance to high heat and deterioration will minimize the friction between the bearing and the shaft rod when the bearing is rotating, and will avoid the noise and friction of conventional bearings in which the lubricating oil runs out relatively rapidly.

To enable better understanding of the objectives, configuration, construction, structural characteristics and performance of the subject invention, please refer to the following detailed description with drawings;

DETAILED DESCRIPTION OF PREFERRED EMBODIMENT

Figure 1:
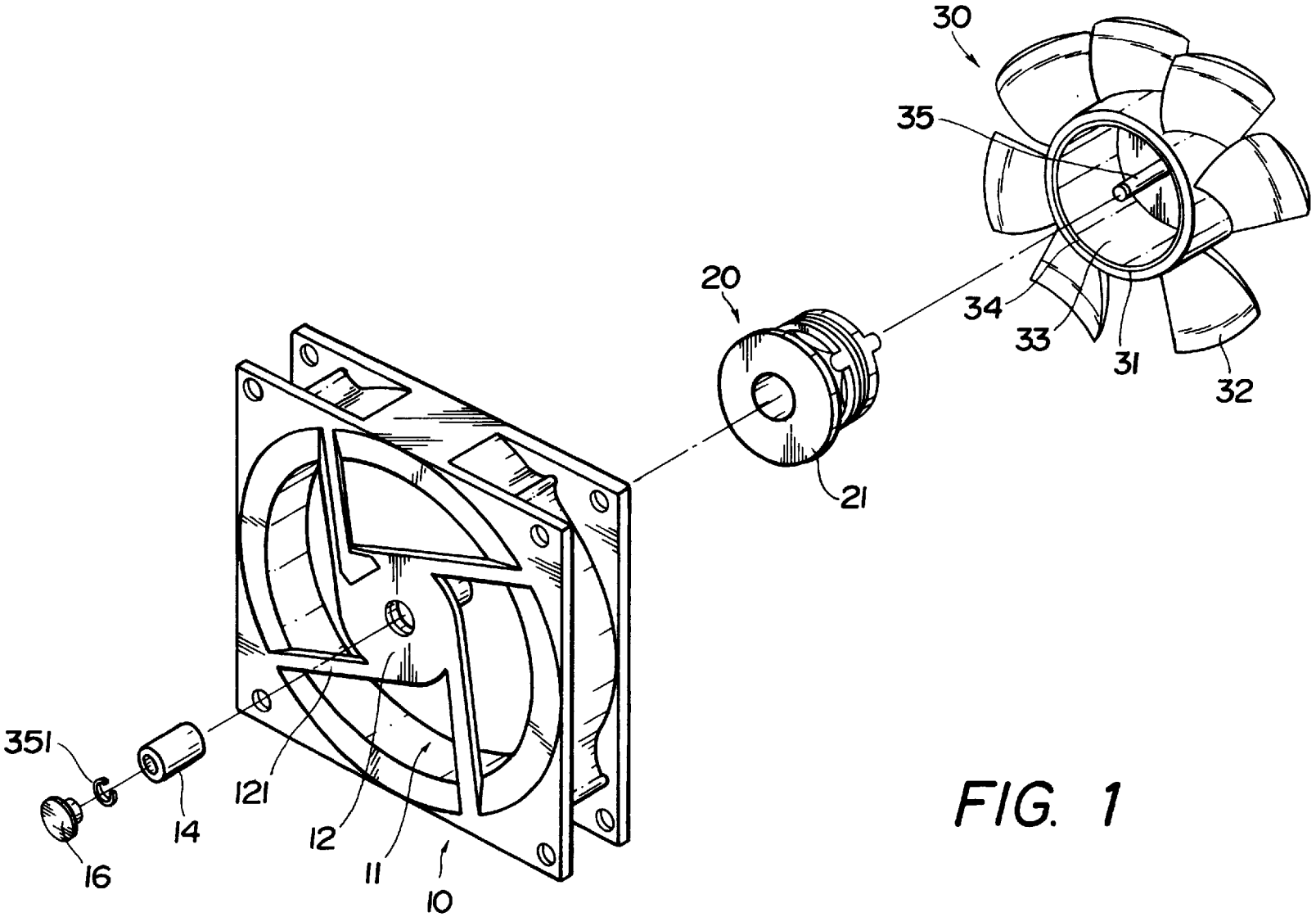
FIG. 1 is an exploded view of the subject invention.
Figure 2:
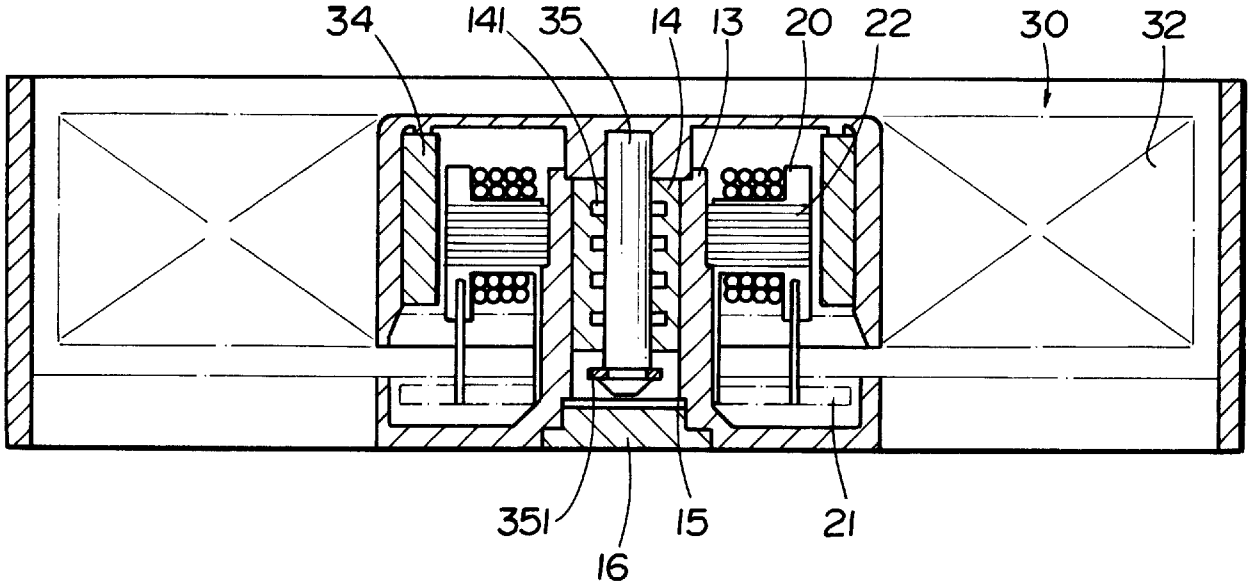
FIG. 2 is an assembled section view of the subject invention.

Referring to FIGS. 1 and 2, the subject invention relates to a fan bearing mechanism made up of:

a frame unit 10, and opening 11 inside the frame unit 10. At the center of the opening is a suspended bearing carrier 12. Around the bearing carrier 12 are pillars 121 that extend from the center and are fixed on the frame unit 10. At the center of the bearing carrier 12 is a hollow post 13 (refer to FIG. 2) that extends upward, and inside hollow post 13 is accommodated a bearing 14. On the inside wall of bearing 14 is at least one ring shaped groove 141 (as shown in FIG. 2) that extends and expands along the radius of the bearing, and at one end of the hollow post 13 on the bearing carrier 12 is a chamber 15 that is coaxial with the hollow post 13 and is filled with lubricating oil. The accommodating chamber 15 will contain an appropriate amount of lubricating oil (in the preferred embodiment, silicone oil is used, but it may be replaced by other equivalent materials by anyone who is skilled in the art), and the area of the chamber 15 is slightly larger than the area of the hollow post 13. Chamber 15 is covered by an oil cap 16.

Onto the surrounding of the hollow post 13 is mounted a stator 20. On the stator 20 is a circuit board 21 that is positioned on the bearing carrier 12. The circuit board 21 has a wiring connection with the stator, and on the stator 20 is the winding of a coil 22 that is composed of copper wires.

Furthermore, in the opening 11 of the frame unit 10 is a fan unit 30. On fan unit 30 is a frame body 31 that is mounted on the bearing carrier 12. Surrounding frame body 31 is a certain number of fan blades 32. On the frame body 31 is a groove 33 that accommodates the stator 20, and on the inside wall of groove 33 is a ring shaped magnet 34. A shaft rod 35 that is integrally formed with the frame body 31 and protrudes outward. The shaft rod 35 may be inserted in the bearing 14. On the free end of said shaft rod 35 is a C-washer 351.

Referring to FIGS. 1 and 2, the assembling procedures are: first, the stator 20 is mounted around the hollow post 13 on the frame unit 10 and the bearing 14 is inserted into the hollow post 13 from the end where chamber 15 is located. Then, the fan unit 30 is mounted onto the hollow post 13 and the shaft rod 35 on the fan unit 30 is inserted in the bearing carrier 12, so that the bearing 14 is fixed in the bearing carrier 12 and surrounds the shaft rod 35. Then silicone oil is filled into chamber 15 and the oil cap 16 is fitted onto chamber 15, so that the ring shaped magnet 34 and the stator 20 will interact and produce a magnetic field that will drive the shaft rod 35 to rotate in the bearing 14 within the bearing carrier 12, which in turn will drive the fan unit 30 to rotate. During the rotation, the ring shaped groove 141 inside the bearing 14 will increase the oil containing capacity of the bearing 14, and since the lubricating silicone oil has such properties of resistance to high heat without deterioration, it will minimize noise and friction between the bearing 14 and the shaft rod 35, and thereby extend the service life of the bearing 14 to approximately that of a roller bearing.

It is declared hereby that the above description, covering only the preferred embodiment of the subject invention, should not be limited or restricted except by the subject claims, and that all equivalent structural and/or configurational variations and/or modifications easily conceivable to anyone skilled in the subject art, or derived from the subject description and drawings herein shall reasonably be included with the scope of the subject claims.

I claim:

1. A bearing structure for a rotor shaft of a radiating fan, comprising:

a frame unit including a hollow post surrounded by a stator and, positioned within the hollow post, a bearing for said rotor shaft, a fan unit mounted on said frame unit and arranged to support a ring-shaped rotor magnet that surrounds said stator, said rotor shaft being affixed to said fan unit so as to extend from said fan unit into said bearing through an opening at a top of said bearing, wherein said fan unit is driven to rotate continuously by magnetic field induction produced by interaction between said stator and said ring-shaped magnet, wherein an inside wall of said bearing has formed therein at least one groove extending circumferentially around said inside wall and arranged to contain a lubricating oil for said bearing and thereby increase an oil containing capacity of the bearing structure for facilitating said rotation of the fan unit, and wherein said bearing is suspended in said hollow post such that a chamber is formed below said bearing, said chamber being surrounded by:

i) said hollow post;

ii) a lower end of said bearing; and iii) an oil cap through which said lubricating oil is introduced into said chamber.

2. A bearing structure as claimed in claim 1, wherein said lubricating oil is silicone oil.

* * * * *